United States Patent [19]

Grosjean

[11] Patent Number: 4,662,553

[45] Date of Patent: May 5, 1987

[54] SHIMMING SYSTEM

[76] Inventor: Robert M. Grosjean, 4625 Merry La., Toledo, Ohio 43615

[21] Appl. No.: 888,289

[22] Filed: Jul. 25, 1986

Related U.S. Application Data

[63] Continuation of Ser. No. 731,985, May 8, 1985, abandoned.

[51] Int. Cl.[4] ..... B26F 3/02; E05D 15/06

[52] U.S. Cl. ..... 225/103; 16/90; 16/247; 52/100; 52/593; 81/418; 384/626; 446/128

[58] Field of Search ..... 16/1 R, 90, 247; 225/93, 94, 96, 96.5, 103; 81/418, 421, 422, 423; 446/87, 117, 118, 128; 52/98, 100, 590, 593; 384/626

[56] References Cited

U.S. PATENT DOCUMENTS

| | | | |
|---|---|---|---|
| 1,272,685 | 7/1918 | Levis | 446/117 X |
| 1,506,675 | 8/1924 | Seppmann | 81/418 X |
| 1,603,891 | 10/1926 | Barr | 52/100 |
| 1,766,459 | 6/1930 | Schweigert | 81/423 |
| 3,140,715 | 7/1964 | Whitton, Jr. et al. | 81/418 X |
| 3,205,529 | 9/1965 | Vintan | 16/90 |
| 3,493,990 | 2/1970 | Winn | 16/90 |
| 3,570,170 | 3/1971 | Kishi | 446/128 |
| 3,717,948 | 2/1973 | Schnabel | 446/128 |
| 4,090,420 | 5/1978 | Insolio | 225/93 |
| 4,206,663 | 6/1980 | Pace | 81/418 X |
| 4,455,709 | 6/1984 | Zanini | 16/90 |
| 4,516,364 | 5/1985 | Heider | 52/593 X |
| 4,524,551 | 6/1985 | Scheiwiller | 52/98 |

FOREIGN PATENT DOCUMENTS

| | | | |
|---|---|---|---|
| 2700210 | 7/1978 | Fed. Rep. of Germany | 52/98 |

*Primary Examiner*—Fred Silverberg
*Attorney, Agent, or Firm*—Allen D. Gutchess, Jr.

[57] ABSTRACT

A shimming system and shim assembly are provided, particularly for door guides and supports for sliding and folding doors of closets and the like. The shim assembly includes shim members having shim plates and projections of different lengths so that different shim members can be assembled in stacked relationship with one another to raise the door guide or support to a desired height. The shim members are of clear plastic material so as not to require painting, staining, or the like. Each shim member can be readily reduced to proper width and length so as to be positioned completely under the base of the door guide or support and thereby be substantially concealed. The shim plates have score grooves by which portions can be broken off to reduce the shim plate to the proper size and the shimming system includes a tool for facilitating removal of the unwanted portions beyond the score grooves. The tool is of sufficient length so as to readily remove end portions of the shim plate beyond transverse grooves or a longitudinal portion of the shim plate beyond a longitudinal groove.

13 Claims, 8 Drawing Figures

SHIMMING SYSTEM

This application is a continuation of my co-pending application Ser. No. 731,985, filed May 8, 1985, now abandoned.

This invention relates to a shimming system including shim members for use with door guides and supports to raise them to desired heights or positions relative to the floor and a tool for reducing the size of the shim members.

Door guides with which the shim members are designed are used on the floors of closet openings at the locations where edge portions of sliding closet doors overlap. Door supports with which the shim members are used are also located in positions to pivotally support bifold doors used to close the closet openings. Heretofore, it has been common to use wooden blocks for shimming the door guides or supports. Since the closet doors are commonly installed after the carpeting is laid, the carpeting usually must be slit and the wooden shim blocks affixed to the floor therebelow when the doors are being installed. Portions of the blocks also are usually exposed above the carpeting, thus requiring that they be coated, as by painting or staining, to provide a neat appearance.

The shimming system according to the invention includes a shim assembly comprising shim members having shim plates and projections extending from a common side thereof. The projections enable the shim members to be fastened to the hard floor through the carpeting without the necessity of slitting the carpeting. This results because the projections apply concentrated forces to the carpeting sufficiently to provide a firm base for the door guide or support without removing the carpeting and any padding thereunder. The shim members are also made of clear plastic material so that coating for appearance is not necessary. The shim members also have narrow score grooves positioned transversely and longitudinally to enable the shim plates to be reduced to a size to fit completely under the base of the door guide or support to minimize exposure of the shim members.

The shim assembly preferably includes three of the shim members having shim plates of the same size and design but with projections of different lengths. Preferably the shim members have projections of one-eighth inch, one-quarter inch, and one-half inch. This enables the shim members to be stacked on one another to achieve any height in increments of one-eighth inch, from one-eighth inch up. Variations in floor level can be one-half inch or more from the edge of a closet opening to the center. Also, particularly with thick carpeting and padding, shim members with a total thickness of three-quarters inch or more are frequently required.

The shimming system according to the invention also includes a unique trimming tool to break off portions of the shim plate beyond the transfer and longitudinal score grooves. The tool includes a pair of longitudinally-extending bars having a closed position in which adjacent edges are spaced apart a distance exceeding the thickness of the shim plate. This enables the adjacent bar edges to loosely engage the shim plate adjacent a score groove. Handles extending from the bars are then manipulated to cause the bars to bend the shim plate adjacent the score groove and cause the plate to sever at the groove. The tool bars are of sufficient length to engage the full length of the shim plate longitudinally as well as the width of the plate transversely.

It is, therefore, a principal object of the invention to provide a shim assembly for facilitating shimming of door guides and supports for closet doors.

Another object of the invention is to provide a shim assembly comprising a plurality of shim members having projections of different lengths, which members are stackable with one another.

Yet another object of the invention is to provide a shim assembly comprising shim members having score grooves by means of which the areas of the shim plates can be reduced to desired sizes.

Yet a further object of the invention is to provide a shimming system including shim members with score grooves and a tool for facilitating removal of portions of shim plates beyond the score grooves.

Many other objects and advantages of the invention will be apparent from the following detailed description of a preferred embodiment thereof, reference being made to the accompanying drawings, in which.

Figure 7:
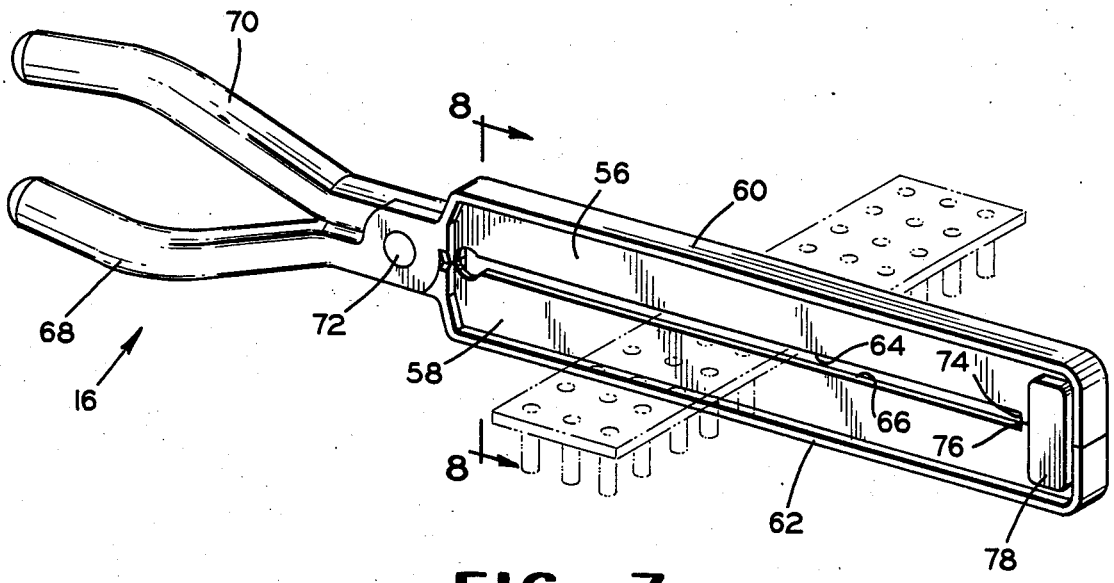
FIG. 7 is a view in perspective of a trimming tool of the shimming system in position to remove a transverse portion of a shim member.
Figure 8:
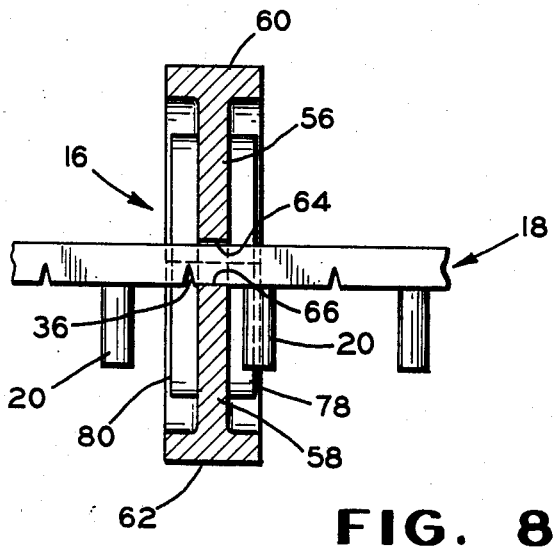
FIG. 8 is a view in section taken along the line 8—8 of FIG. 7.

Referring to the drawings, a shimming system in accordance with the invention includes a shim assembly comprising three shim members 10, 12, and 14 of FIGS. 1–5 and a trimming tool 16 of FIGS. 7 and 8. The shim member 10 of FIGS. 1–3 includes a shim plate 18 and projections 20. The shim plate 18 is of rectangular configuration, having two straight longitudinal first edges 22 and 24 and two straight end or transverse edges 26 and 28.

An upper surface 30 of the plate 18 has a multiplicity of shallow recesses 32 therein which are positioned directly opposite the projections 20 and are located in longitudinal and tranverse rows. The recesses 32 are circular in transverse cross section and are spaced apart one-half inch in the longitudinal rows and three-eighths inch in the transverse rows. The depth of the recesses is from one-fifth to one-third the thickness of the plate 18 and preferbly about one-fourth the thickness. In a preferred form, the recesses have a depth of about 0.03 inch with the plate having a thickness of 0.125 inch. There are eleven of the recesses 32 in each longitudinal row and four of the recesses in each transverse row with the plate having a length of five and one-half inches and a width of one and one-half inches. As such, the plate 18 is of a size to fit with the base of the largest commercial door guide or support which is to be used with closet doors.

A lower surface 34 of the plate 18 is parallel to the upper surface with the projections 20 all extending from the lower surface 34. The lower surface 34 has a plurality, specifically four, narrow score grooves 36 extending transversely thereof between five of the transverse rows of the recesses and projections nearer one of the transverse edges 26 and 28 at an end of the plate. The score grooves 36 are of inverted "V" shaped configuration and have a depth of about one-half the thickness of the plate 18 with the widest portion of the grooves being about 0.03 inch. The plate 18 also has a longitudinally extending narrow score groove 38 extending the length of the plate between two of the longitudinal rows of the recesses and projections nearer one of the longitudinal edges 22 and 24 of the plate 18. The narrow score groove 38 also is of the same size and shape as the transverse grooves 36.

The narrow score grooves 36 and 38 enable the plate 18 to be reduced in length and width to fit closely under the bases of door guides and supports which are commonly commercially available. The close fit minimizes exposure of the shim member which is also of clear plastic material. Consequently, the shim members need not be coated, as by painting or staining, to provide a neat appearance as do wooden shim blocks heretofore used.

The projections 20 of the shim member 10 include cylindrical shanks 40 of uniform size throughout their lengths and terminating in blunt ends 42. The projections are slightly smaller in diameter than the recesses 32 so that the ends 42 can fit into the recesses 32 to place the shim members in stable, slightly nesting relationship when stacked. The projections 20 are equal in number to the recesses 32 and are equal in spacing in the longitudinal and transverse rows. With the recesses 32 being slightly larger than the projections, the nesting relationship will still occur even if the dimensional spacing of the recesses and projections vary slightly.

Figure 1:
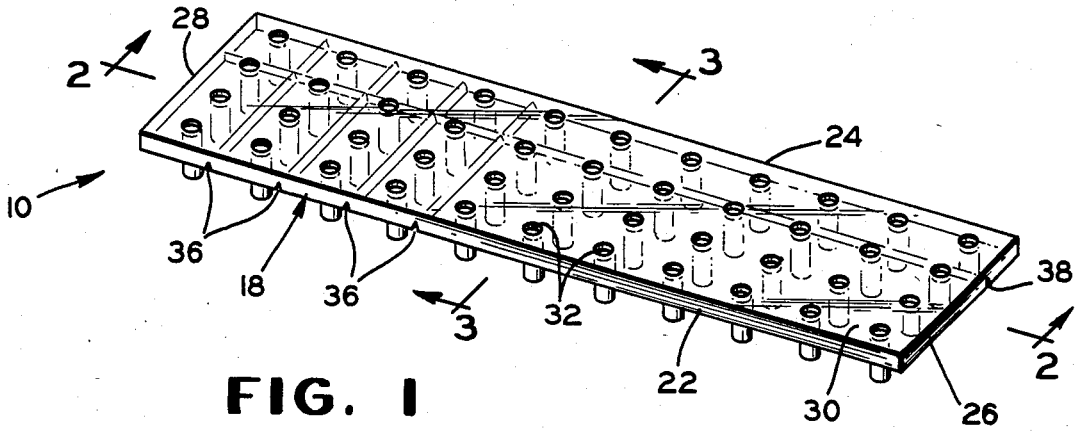
FIG. 1 is a view in perspective of a shim member in accordance with the invention.
Figure 2:
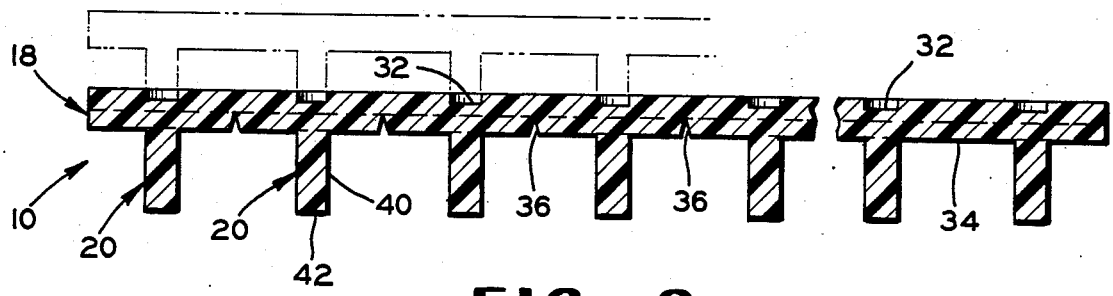
FIG. 2 is a view in longitudinal cross section taken along the line 2—2 of FIG. 1.
Figure 3:
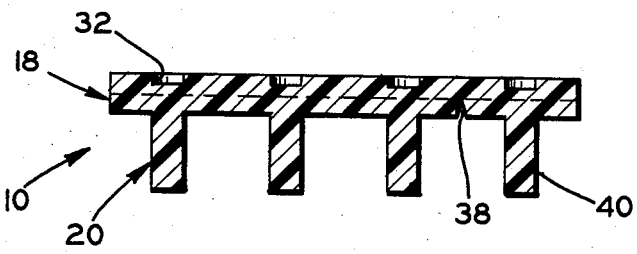
FIG. 3 is a view in transverse cross section taken along the line 3—3 of FIG. 1.
Figure 4:
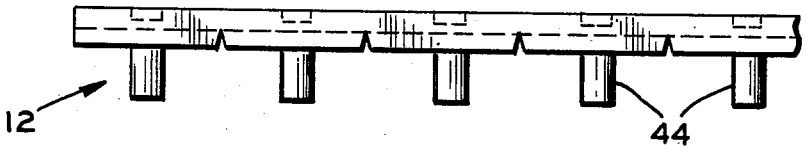
FIG. 4 is a fragmentary, side view in elevation of another shim member of the shim assembly.
Figure 5:
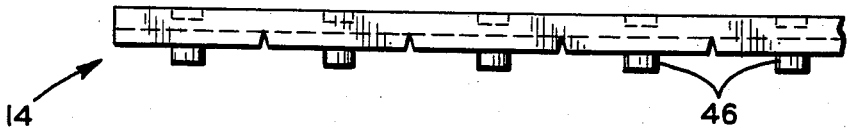
FIG. 5 is a view similar to FIG. 4 of a third shim member of the shim assembly.

The shim member 12 of FIG. 4 is identical to the shim member 10 except that the member 12 has projections 44 which are shorter in length than the projections 20. In this instance, the projections 20 are twice the length of the projections 44.

The shim member 14 is also identical to the shim member 10 except for projections 46. These are shorter than the projections 20 and 44, being one-half the length of the projections 44.

With the shim assembly which comprises the three shim members 10, 12, and 14, various shimming heights can be built up by stacking the shim members. Thus, with the projections 20 being one-half inch, the projections 44 being one-fourth inch, and the projections 46 being one-eighth inch, a shimming height from one-eighth inch to any desired height in one-eighth increments can be obtained. A variation of one-half inch in the floor level from an edge of a closet opening to the center thereof is not uncommon for concrete floors or for wooden floors where settling occurs. Also, the doors may be hung with their lower edges spaced above the base floor by one inch or more, particularly where thick carpeting and padding are employed therebetween. Consequently, shimming to a height of three-quarter inch or more frequently is needed. This can be readily accomplished by stacking two or more of the shim members 10–14.

Figure 6:
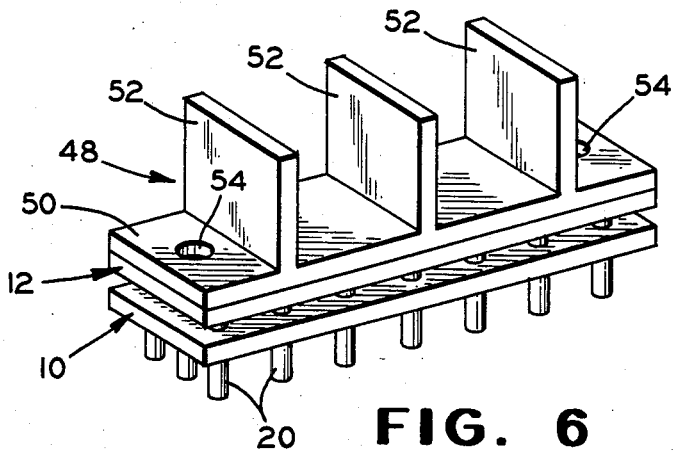
FIG. 6 is a view in perspective of two of the shim members stacked together and assembled under a closet door guide.

Referring to FIG. 6, one of the shim members 12 is shown stacked on one of the shim members 10. A closest door guide 48, which is commercially available, is place on top of the shim member 12. The guide 48 includes a base 50 and upstanding flanges 52. Lower edge portions of two closet doors are received between the flanges with the guide 48 positioned on the floor at a middle lower portion of the closet opening to receive overlapping portions of the doors. The doors commonly are available in thickness ranging from one and three-eighth inches to one and three-quarter inches so that the size of the door guide 48 will vary, along with the size of the base 50.

The edges of the shim plates 18 are trimmed to fit with the guide base so as not to project therefrom and present an unsightly appearance. With the shim members 10 and 12 stacked and the guide 48 placed thereon, holes can be drilled through the shim members through fastener openings 54 in the base with fasteners extended through the three openings and used to securely fasten the assembly to the floor. The projections 20 apply concentrated forces to the carpeting and padding to provide a firm support for the assembly without the necessity of slitting and trimming the carpeting therebelow.

The trimming tool 16 of the shimming system enables the shim plates 18 to be trimmed along the score lines 36 and 38 in a manner to provide neat edges. Referring to FIGS. 7 and 8, the trim tool 16 basically includes two elongate bars 56 and 58 having outer, functionally-integral stiffening flanges 60 and 62. The bars have adjacent, square edges 64 and 66 which, when the bars are in their closed position shown in FIGS. 7 and 8, are spaced apart a distance slightly exceeding the thickness of the shim plate 18. The upper bar 56 and the flange 60 are connected to a lower handle 68 while the lower bar 58 and the flange 62 are connected to an upper handle 70, the two handles being pivotally joined by a pivot pin 72. The handles enable the tool 16 to be manipulated and to move the bars 56 and 58 between any suitable open position (not shown) and the closed position. Outer edge portions 74 and 76 are in contact when the tool is in the closed position and maintain the distance between the square edges 64 and 66 when the bars are in their closed position. The upper bar 56, in this instance, has a pair of depending end flanges 78 and 80 affixed thereto which extend over sides of the lower bar 58 at the ends thereof and prevent the bars 56 and 58 from being twisted or transversely displaced when the tool is in its closed position.

In the operation of the tool 16, the handles 68 and 70 are spread apart to place the bars 56 and 58 in an open position with the tool then being positioned over the shim member and the bars then moved to the closed position near the score groove 36 or 38 at which the shim plate is to be severed. The handles 68 and 70 are then turned to cause the bars 56 and 58 to tend to twist. This places a bending force on the plate 18 near the score groove 36 or 38. The plate 18 is thereby bent until it breaks cleanly at the score groove. The bars 56 and 58 are of sufficient length so as to engage the shim member longitudinally and sever a portion therefrom at the score line 38 in one movement.

Various modifications of the above-described embodiment of the invention will be apparent to those skilled in the art and it is to be understood that such modifications can be made withotu departing from the scope of the invention, if they are within the spirit and the tenor of the accompanying claims.

I claim:

1. A shimming system comprising a shim assembly including a first shim member comprising a rectangular first plate having two straight longitudinal first edges and two straight end first edges which are perpendicular to the longitudinal first edges, a plurality of uniformly-spaced first projections extending perpendicularly to said first plate from a common first side thereof, said first projections being uniformly spaced apart in longitudinal first rows and uniformly spaced apart in transverse first rows, said longitudinal first rows being parallel to the longitudinal first edges of said first plate and said transverse first rows being parallel to the end first edges of said first plate, said first projections being circular in transverse cross section, said first projections also being of uniform length, said first plate having a planar first surface on the side opposite said common first side, said planar first surface having a plurality of first recesses therein in positions directly opposite the positions of said first projections, said shim assembly including a second shim member comprising a rectangular second plate having two straight longitudinal second edges and two straight end second edges which are perpendicular to the longitudinal second edges, a plurality of uniformly-spaced second projections extending perpendicularly to said second plate from a common second side thereof, said second projections being uniformly spaced apart in longitudinal second rows and uniformly spaced apart in transverse second rows, said longitudinal second rows being parallel to the longitudinal second edges of said second plate and said transverse second rows being parallel to the end second edges of said second plate, said second projections being circular in transverse cross section, said second projections also being of uniform length which exceeds the length of said first projections, said second plate having a planar second surface on the side opposite said common second side, said planar second surface having a plurality of second recesses therein in positions directly opposite the positions of said second projections, said shim assembly including a third shim member comprising a rectangular third plate having two straight longitudinal third edges and two straight end third edges which are perpendicular to the longitudinal third edges, a plurality of uniformly-spaced third projections extending perpendicularly to said third plate from a common third side thereof, said third projections being uniformly spaced apart in longitudinal third rows and uniformly spaced apart in transverse third rows, said longitudinal third rows being parallel to the longitudinal third edges of said third plate and said transverse third rows being parallel to the end third edges of said third plate, said third projections being circular in transverse cross section, said third projections also being of uniform length which exceeds the length of said second projections, said third plate having a planar third surface on the side opposite said common third side, said planar third surface having a plurality of third recesses therein in positions directly opposite the positions of said third projections, said first recesses being of a size and shape to receive ends of said second projections and said third projections, said second recesses being of a size and shape to receive ends of said first projections and said third projections, and said third recesses being of a size and shape to receive ends of said first projections and said second projections, said first recesses having depths which are substantially less than the lengths of each of said first, second, and third projections, said second recesses having depths which are substantially less than the lengths of each of said first, second, and third projections, said third recesses having depths which are substantially less than the lengths of each of said first, second, and third projections, whereby the cooperation of said recesses and said projections enable said shim members to be placed in stable, slightly nesting relationship when stacked, with the shim plates of the stacked shim members being in spaced relationship, said shimming system further comprising a tool for separating a portion of one of said rectangular shim plates from another portion along a score groove separating the two portions, said tool including a first handle, a second handle, a first elongate bar extending outwardly from said first handle and having a first longitudinally-extending, straight edge, a second elongate bar extending outwardly from said second handle and having a second longitudinally-extending, straight edge, said tool having pivot means located beyond ends of said straight edges pivotally connecting said first handle and said first elongate bar to said second handle and said second elongate bar, said tool having means located beyond ends of said straight edges for limiting the extent to which said bars can move together when in a closed position, said first edge and said second edges being spaced apart in parallel relationship when said bars are in the closed position with the spacing between said first and second edges slightly exceeding the thickness of said shim plates, and means affixed to at least one of said bars beyond the end of the associated straight edge opposite the end nearer said pivot means for preventing said bars from moving transversely relative to one another when said bars are in the closed position.

2. A shimming system according to claim 1 characterized by said second projections having a length which is twice the length of said first projections and said third projections having a length which is twice the length of said second projections.

3. A shim assembly including a first shim member comprising a rectangular first plate having two straight longitudinal first edges and two straight end first edges which are perpendicular to the longitudinal first edges, a plurality of uniformly-spaced first projections extending perpendicularly to said first plate from a common first side thereof, said first projections being uniformly spaced apart in longitudinal first rows and uniformly spaced apart in transverse first rows, said longitudinal first rows being parallel to the longitudinal first edges of said first plate and said transverse first rows being parallel to the end first edges of said first plate, said first projections being circular in transverse cross section, said first projections also being of uniform length, said first plate having a planar first surface on the side opposite said common first side, said planar first surface having a plurality of first recesses therein in positions directly opposite the positions of said first projections, said shim assembly including a second shim member comprising a rectangular second plate having two straight longitudinal second edges and two straight end second edges which are perpendicular to the longitudinal second edges, a plurality of uniformly-spaced second projections extending perpendicularly to said second plate from a common second side thereof, said second projections being uniformly spaced apart in longitudinal second rows and uniformly spaced apart in transverse second rows, said longitudinal second rows being parallel to the longitudinal second edges of said second plate and said transverse second rows being parallel to the end second edges of said second plate, said second projections also being of uniform length which exceeds the length of said first projections, said second plate having a planar second surface on the side opposite said common second side, said planar second surface having a plurality of second recesses therein in positions directly opposite the positions of said second projections, said shim assembly including a third shim member comprising a rectangular third plate having two straight longitudinal third edges and two straight end third edges which are perpendicular to the longitudinal third edges, a plurality of uniformly-spaced third projections extending perpendicularly to said third plate from a common third side thereof, said third projections being uniformly spaced apart in longitudinal third rows and uniformly spaced apart in transverse third rows, said longitudinal third rows being parallel to the longitudinal third edges of said third plate and said transverse third rows being parallel to the end third edges of said third plate, said third projections being circular in transverse cross section, said third projections also being of uniform length which exceeds the length of said second projections, said third plate having a planar third surface on the side opposite said common third side, said planar third surface having a plurality of third recesses therein in positions directly opposite the positions of said third projections, said first recesses being of a size and shape to receive ends of said second projections and said third projections, said second recesses being of a size and shape to receive ends of said first projections and said third projections, and said third recesses being of a size and shape to receive ends of said first projections and said second projections, said first recesses having depths which are substantially less than the lengths of each of said first, second, and third projections, said second recesses having depths which are substantially less than the lengths of each of said first, second, and third projections, said third recesses having depths which are substantially less than the lengths of each of said first, second, and third projections, whereby the cooperation of said recesses and said projections enable said shim members to be placed in stable, slightly nesting relationship when stacked, with the shim plates of the stacked shim members being in spaced relationship.

4. A shim assembly according to claim 3 characterized by the length of said second projections being twice the length of said first projections and the length of said third projections being twice the length of said second projections.

5. A shim assembly according to claim 3 characterized by said rectangular first plate having a narrow first groove extending longitudinally thereof between two of said longitudinal first rows which are closest to one of said longitudinal first edges, said rectangular second plate having a narrow second groove extending longitudinally thereof between two of said longitudinal second rows which are closest to one of said longitudinal second edges, and said rectangular third plate having a narrow third groove extending longitudinally thereof between two of said longitudinal third rows which are closest to one of said longitudinal third edges.

6. A shim assembly according to claim 5 characterized by said rectangular first plate having a plurality of narrow first grooves located between a plurality of said transverse first rows which are closest to one of said straight end first edges, said rectangular second plate having a plurality of narrow second grooves located between a plurality of said transverse second rows which are closest to one of said straight end second edges, and said rectangular third plate having a plurality of narrow third grooves located between a plurality of said transverse third rows which are closest to one of said straight end third edges.

7. A shim assembly according to claim 3 characterized by said rectangular first plate having a narrow first groove between two of said transverse first rows which are closest to one of said straight end first edges, said rectangular second plate having a narrow second groove between two of said transverse second rows which are closest to one of said straight end second edges, and said rectangular third plate having a third narrow groove between two of said transverse third rows which are closest to one of said straight end third edges.

8. A shim assembly according to claim 3 characterized by said rectangular first plate having a plurality of narrow first grooves located between a plurality of said transverse first rows which are closest to one of said straight end first edges, said rectangular second plate having a plurality of narrow second grooves located between a plurality of said transverse second rows which are closest to one of said straight end second edges, and said rectangular third plate having a plurality of narrow third grooves located between a plurality of said transverse third rows which are closest to one of said straight end third edges.

9. A shim assembly including a first shim member comprising a rectangular first plate having two straight longitudinal first edges and two straight end first edges which are perpendicular to the longitudinal first edges, a plurality of uniformly-spaced first projections extending perpendicularly to said first plate from a common first side thereof, said first projections being uniformly spaced apart in longitudinal first rows and uniformly spaced apart in transverse first rows, said longitudinal first rows being parallel to the longitudinal first edges of said first plate and said transverse first rows being parallel to the end first edges of said first plate, said first projections being circular in transverse cross section, said first projections also being of uniform length, said first plate having a planar first surface on the side opposite said common first side, said planar first surface having a plurality of first recesses therein in positions directly opposite the positions of said first projections, said shim assembly including a second shim member comprising a rectangular second plate having two straight longitudinal second edges and two straight end second edges which are perpendicular to the longitudinal second edges, a plurality of uniformly-spaced second projections extending perpendicularly to said second plate from a common second side thereof, said second projections being uniformly spaced apart in longitudinal second rows and uniformly spaced apart in transverse second rows, said longitudinal second rows being parallel to the longitudinal second edges of said second plate and said transverse second rows being parallel to the end second edges of said second plate, said second projections also being of uniform length which exceeds the length of said first projections, said second plate having a planar second surface on the side opposite said common second side, said planar second surface having a plurality of second recesses therein in positions directly opposite the positions of said second projections, said first recesses being of a size and shape to receive ends of said second projections, said second recesses being of a size and shape to receive ends of said first projections, said first recesses having depths which are substantially less than the lengths of each of said first and second projections, and said second recesses having depths which are substantially less than the lengths of each of said first and second projections, whereby the cooperation of said recesses and said projections enable said shim members to be placed in stable, slightly nesting relationship when stacked, with the shim plates of the stacked shim members being in spaced relationship.

10. A shim assembly according to claim 9 characterized by the length of said second projections being twice the length of said first projections.

11. A shim assembly according to claim 9 characterized by said rectangular first plate having a narrow first groove extending longitudinally thereof between two of said longitudinal first rows which are closest to one of said longitudinal first edges, and said rectangular second plate having a narrow second groove extending longitudinally thereof between two of said longitudinal second rows which are closest to one of said longitudinal second edges.

12. A shim assembly according to claim 9 characterized by said rectangular first plate having a narrow first groove between two of said transverse first rows which are closest to one of said straight end first edges, and said rectangular second plate having a narrow second groove between two of said transverse second rows which are closest to one of said straight end second edges.

13. A tool for separating a portion of a shim plate from another portion of said shim plate along a score groove separating the two portions, said tool comprising a first handle, a second handle, a first elongate bar extending outwardly from said first handle and having a first straight edge extending longitudinally of said bar, a second elongate bar extending outwardly from said second handle and having a second straight edge extending longitudinally of said second elongate bar, said first edge and said second edge being in aligned, parallel relationship when said bars are in a closed position, pivot means pivotally connecting said first handle and said first elongate bar to said second handle and said second elongate bar, said pivot means being beyond corresponding ends of said first edge and said second edge, means affixed to at least one of said bars beyond the end of the associated edge opposite the end nearer said pivot means for preventing said bars from moving transversely relative to one another when said bars are in the closed position, and said bars having means beyond corresponding ends of said first and second edges for limiting the extent to which said bars can move together when in the closed position, with the spacing between said first and second edges slightly exceeding the thickness of said shim plate; said first and second handles, said first and second elongate bars and said first and second straight edges all lying in a common single plane.

* * * * *